US006334660B1

(12) United States Patent
Holstun et al.

(10) Patent No.: US 6,334,660 B1
(45) Date of Patent: Jan. 1, 2002

(54) VARYING THE OPERATING ENERGY APPLIED TO AN INKJET PRINT CARTRIDGE BASED UPON THE OPERATING CONDITIONS

(75) Inventors: Clayton L. Holstun, San Marcos; Tina R Fuchs, Las Flores, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/183,949

(22) Filed: Oct. 31, 1998

(51) Int. Cl.[7] ..... B41J 29/38
(52) U.S. Cl. ..... 347/19; 347/14; 347/190
(58) Field of Search ..... 347/5, 9, 10, 14, 347/19, 48, 12, 13, 17, 18, 190

(56) References Cited

U.S. PATENT DOCUMENTS

| | | | | |
|---|---|---|---|---|
| 5,017,948 A | * | 5/1991 | Koizumi et al. | 347/14 |
| 5,418,558 A | | 5/1995 | Hock et al. | 347/14 |
| 5,428,376 A | | 6/1995 | Wade et al. | 347/14 |
| 5,446,475 A | * | 8/1995 | Patry | 347/191 |
| 5,469,203 A | * | 11/1995 | Hauschild | 347/190 |
| 5,497,174 A | | 3/1996 | Stephany et al. | 347/13 |
| 5,606,355 A | * | 2/1997 | Komatsu | 347/60 |
| 5,677,577 A | * | 10/1997 | Barbehen et al. | 307/98 |
| 5,682,185 A | | 10/1997 | Wade et al. | 347/19 |
| 5,689,292 A | * | 11/1997 | Suzuki et al. | 347/17 |
| 6,036,297 A | * | 3/2000 | Hayasaki | 347/13 |
| 6,116,717 A | * | 9/2000 | Anderson et al. | 347/19 |

FOREIGN PATENT DOCUMENTS

| | | |
|---|---|---|
| EP | 0 318 328 | 5/1989 |
| WO | WO 96 32271 | 10/1996 |

OTHER PUBLICATIONS

U.S. application No. 09/016,478, Askeland et al., filed Jan. 30, 1998.
U.S. application No. 09/071,138, Wade et al., filed Apr. 30, 1998.
U.S. application No. 08/962,031, Pietrzyk et al., filed Oct. 31, 1997.
U.S. application No. 08/958,951, Corrigan et al., filed Oct. 28, 1997.
U.S. application No. 08/960,945, Feinn et al., filed Oct. 31, 1997.

* cited by examiner

*Primary Examiner*—John Barlow
*Assistant Examiner*—Blaise Mouttet
(74) *Attorney, Agent, or Firm*—Dennis G. Stenstrom

(57) ABSTRACT

Disclosed is a method of operating an inkjet printer having one or more inkjet print cartridges installed in the printer, wherein the printer is capable of operating under varying operating conditions and in a plurality of different printmodes, including obtaining a value for the common parasitic resistances and a base operating voltage setting for the inkjet printer when a predetermined number of possible resistors on the print cartridge are firing during a given period of time, determining an actual number of resistors firing on the print cartridge during the given period of time, adjusting the base operating voltage setting to a selected voltage setting based on the results of said obtaining step and said determining step and operating the printer using the selected operating voltage setting for the print cartridge.

25 Claims, 8 Drawing Sheets

VARYING THE OPERATING ENERGY APPLIED TO AN INKJET PRINT CARTRIDGE BASED UPON THE OPERATING CONDITIONS

CROSS-REFERENCE TO RELATED APPLICATIONS

This application is related to U.S. patent application Ser. No. 09/071,138, filed Apr. 30, 1998, entitled "Energy Control Method for an Inkjet Print Cartridge;" U.S. patent application Ser. No. 08/958,951, filed Oct. 28, 1997, entitled "Thermal Ink Jet Print Head and Printer Energy Control Apparatus and Method," U.S. Pat. No. 5,418,558, entitled "Determining the Operating Energy of a Thermal Ink Jet Printhead Using an Onboard Thermal Sense Resistor;" U.S. Pat. No. 5,428,376, entitled "Thermal Turn on Energy Test for an Inkjet Printer;" U.S. Pat. No. 5,682,185 entitled "Energy Management Scheme for an Ink Jet Printer;" U.S. patent application Ser. No. 09/016,478, filed Jan. 30, 1998, entitled "Hybrid Multi-Drop/Multi-Pass Printing System;" U.S. patent application Ser. No. 08/962,031, filed Oct. 31, 1997, entitled "Ink Delivery System for High Speed Printing" and U.S. patent application Ser. No. 08/960,945, filed Oct. 31, 1997, entitled "Apparatus and Method for Generating High Frequency Ink Ejection and Ink Chamber Refill." The foregoing commonly assigned patents and patent applications are herein incorporated by reference.

FIELD OF THE INVENTION

This invention relates to thermal inkjet printers, and more particularly to the control of the printhead firing energy.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988). The basics of this technology are further disclosed in various articles in several editions of the Hewlett-Packard Journal [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or "pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle and has a firing resistor located in the chamber. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

In an inkjet printhead the ink is fed from an ink reservoir integral to the printhead or an "off-axis" ink reservoir which feeds ink to the printhead via tubes connecting the printhead and reservoir. Ink is then fed to the various vaporization chambers either through an elongated hole formed in the center of the bottom of the substrate, "center feed", or around the outer edges of the substrate, "edge feed."

The ink cartridge containing the nozzles is moved repeatedly across the width of the medium to be printed upon. At each of a designated number of increments of this movement across the medium, each of the resistors is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

The energy applied to a firing resistor affects performance, durability and efficiency. It is well known that the firing energy must be above a certain firing threshold to cause a vapor bubble to nucleate. Above this firing threshold is a transitional range where increasing the firing energy increases the volume of ink expelled. Above this transitional range, there is a higher optimal range where drop volumes do not increase with increasing firing energy. In this optimal range above the optimal firing threshold drop volumes are stable even with moderate firing energy variations. Since, variations in drop volume cause disuniformities in printed output, it is in this optimal range that printing ideally takes place. As energy levels increase in this optimal range, uniformity is not compromised, but energy is wasted and the printhead is prematurely aged due to excessive heating and ink residue build-up.

In existing printheads having a dedicated connection for each firing resistor, or for a group of resistors called a primitive, a one time calibration of each connection by either the printer or production circuitry external to the print cartridge also compensates for any parasitic resistance or impedance in the unique path leading to each resistor. Printheads may be characterized at production to set these operating parameters. The printer then uses these operating parameters.

However, in new smart drive printheads wherein each firing resistor or each primitive does not have a dedicated connection, there may be variations due to other factors. A large number of resistors is powered by a single voltage line that receives power via an electrical contact pad between the printer electronics and the removable print cartridge. Consequently, as the data load being printed changes, the current draw through the line and the voltage as measured at the firing resistor may be undesirably varied. For instance, when many or all resistors are fired simultaneously, the print cartridge voltage may be depressed by parasitic effects, giving a lower firing voltage than when only one or a few resistors are fired.

Accordingly, there is a need for a method of operating an inkjet printer with a printhead having a plurality of ink firing resistors that overcomes the above problems.

SUMMARY OF THE INVENTION

The present invention provides a method of operating an inkjet printer having one or more inkjet print cartridges installed in the printer, wherein the printer is capable of operating under varying operating conditions and in a plurality of different printmodes, including obtaining a value for the common parasitic resistances and a base operating voltage setting for the inkjet printer when a predetermined number of possible resistors on the print cartridge are firing during a given period of time, determining an actual number of resistors firing on the print cartridge during the given period of time, adjusting the base operating voltage setting to a selected voltage setting based on the results of said obtaining step and said determining step and operating the printer using the selected operating voltage setting for the print cartridge.

DETAILED DESCRIPTION OF A PREFERRED EMBODIMENT

Figure 1:
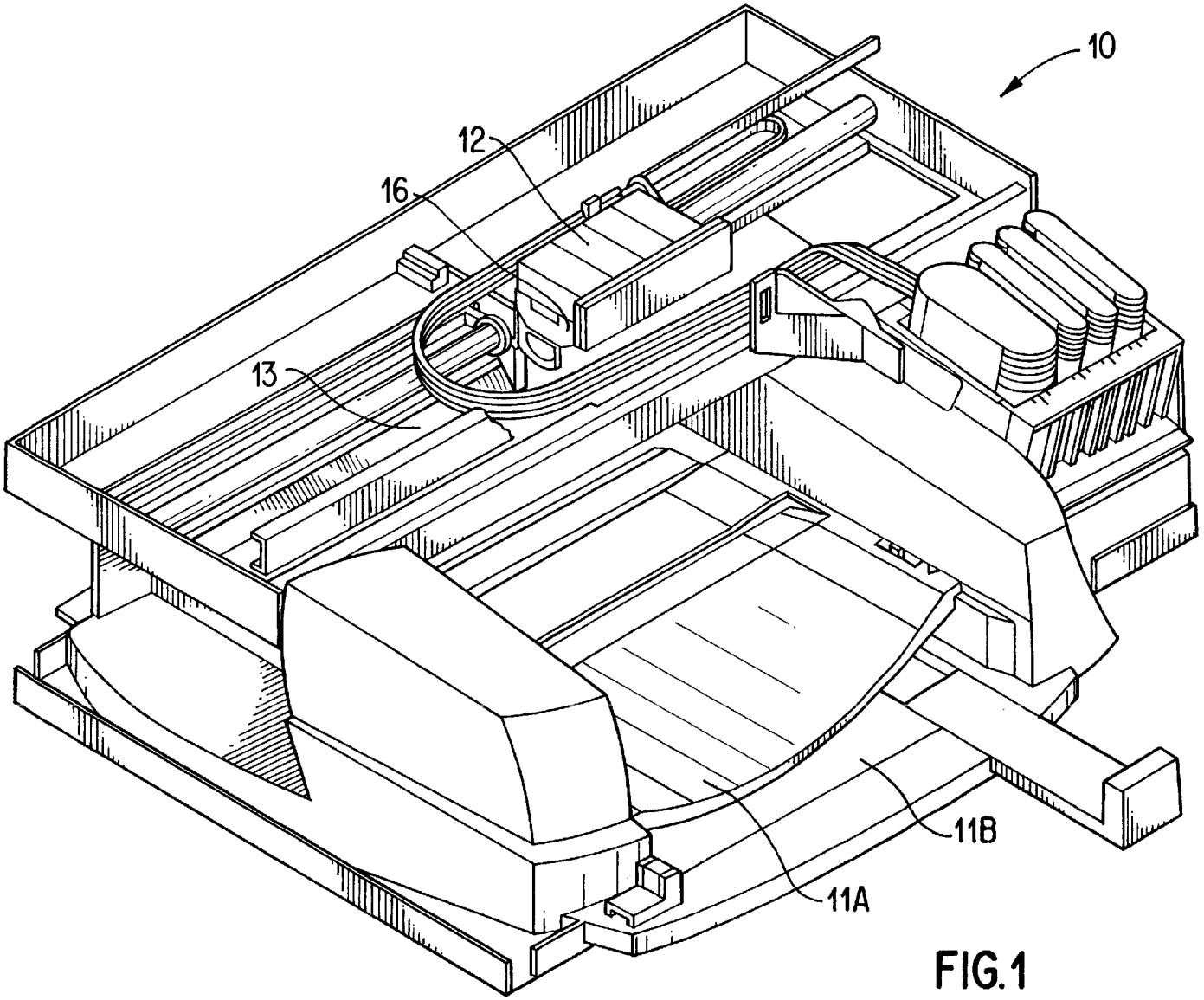
FIG. 1 is a perspective view of one embodiment of an inkjet printer incorporating the present invention.

FIG. 1 is a perspective view of one embodiment of an inkjet printer 10 suitable for utilizing the present invention, with its cover removed. Generally, printer 10 includes a tray 11A for holding virgin paper. When a printing operation is initiated, a sheet of paper from input tray 11A is fed into printer 10 using a sheet feeder, then brought around in a U direction to now travel in the opposite direction toward output tray 11B. The sheet is stopped in a print zone 13, and a scanning carriage 16, supporting one or more print cartridges 12, is then passed across a print zone on the sheet for printing a swath of ink thereon. The printing may occur while the carriage is passing in either directional. This is referred to as bidirectional printing. After a single pass or multiple passes, the sheet is then incrementally shifted an amount based on the printmode being used, using a conventional stepper motor and feed rollers to a next position within the print zone 13, and carriage 16 again passes across the sheet for printing a next swath of ink. When the printing on the sheet is complete, the sheet is forwarded to a position above tray 11B, held in that position to ensure the ink is dry and then released.

The carriage 16 scanning mechanism may be conventional and generally includes a slide rod, along which carriage 16 slides, a flexible cable (not shown in FIG. 1) for transmitting electrical signals from the printer's controller to the carriage 16 and then to electrodes on the carriage 16 which engage electrical contacts 86 on print cartridges 12 when they are installed in the printer. A motor (not shown), connected to carriage 16 using a conventional drive belt and pulley arrangement, may be used for transporting carriage 16 across print zone 14.

Figure 2:
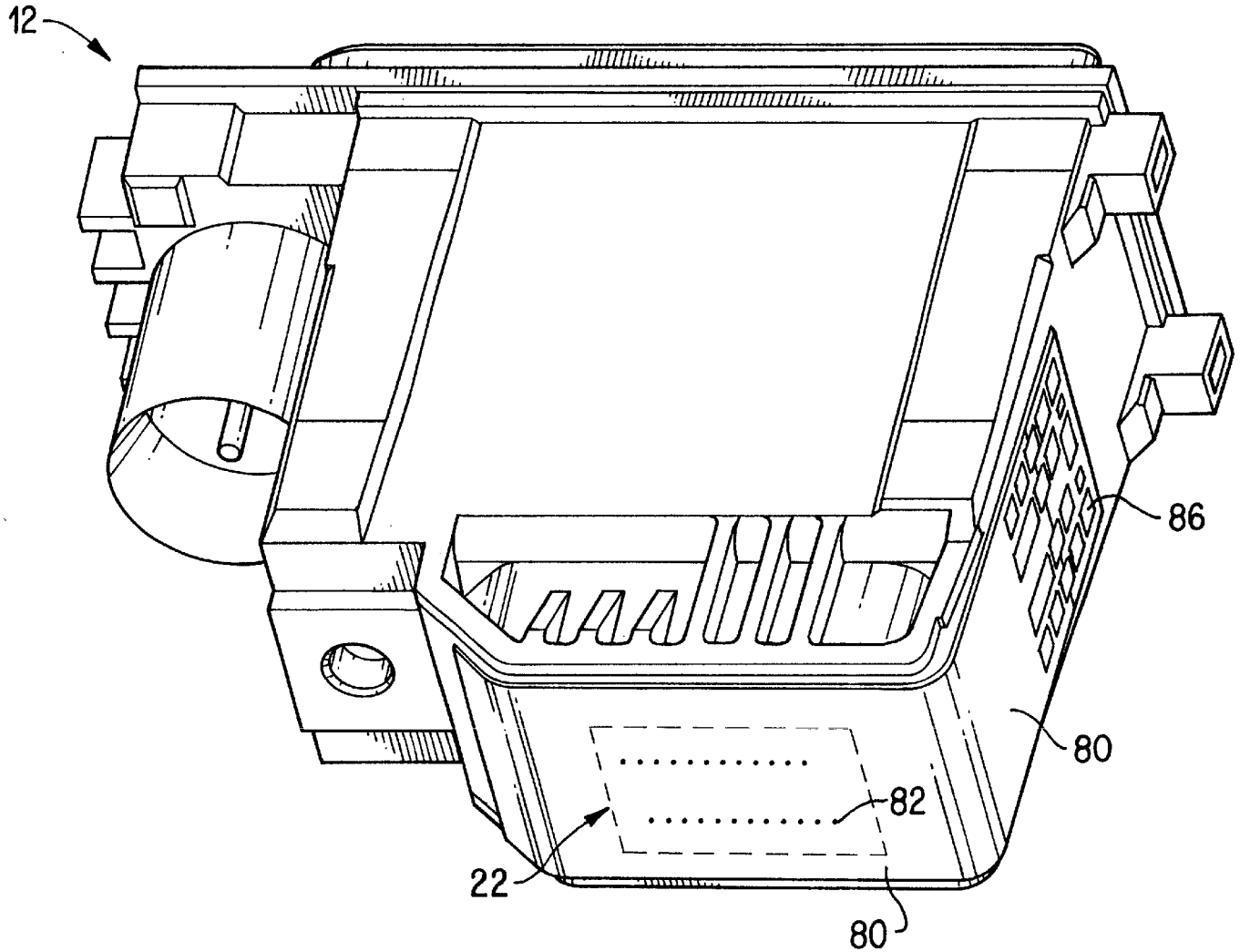
FIG. 2 is a top perspective view of a single print cartridge.

FIG. 2 illustrates a print cartridge 12 having a printhead assembly 22 attached which includes a flexible tape 80 containing nozzles 82 and electrical contact pads 86. The contact pads 86 align with and electrically contact electrodes (not shown) on carriage 16. The print cartridge also includes a memory device for storing calibration information determined on the manufacturing line or subsequently. Values typically include operating voltage, operating energy, turn-on energy, print cartridge resistances including common parasitic resistances and drop volumes. This information can the be read and stored by the printer when the print cartridge is installed in the printer.

Figure 3:
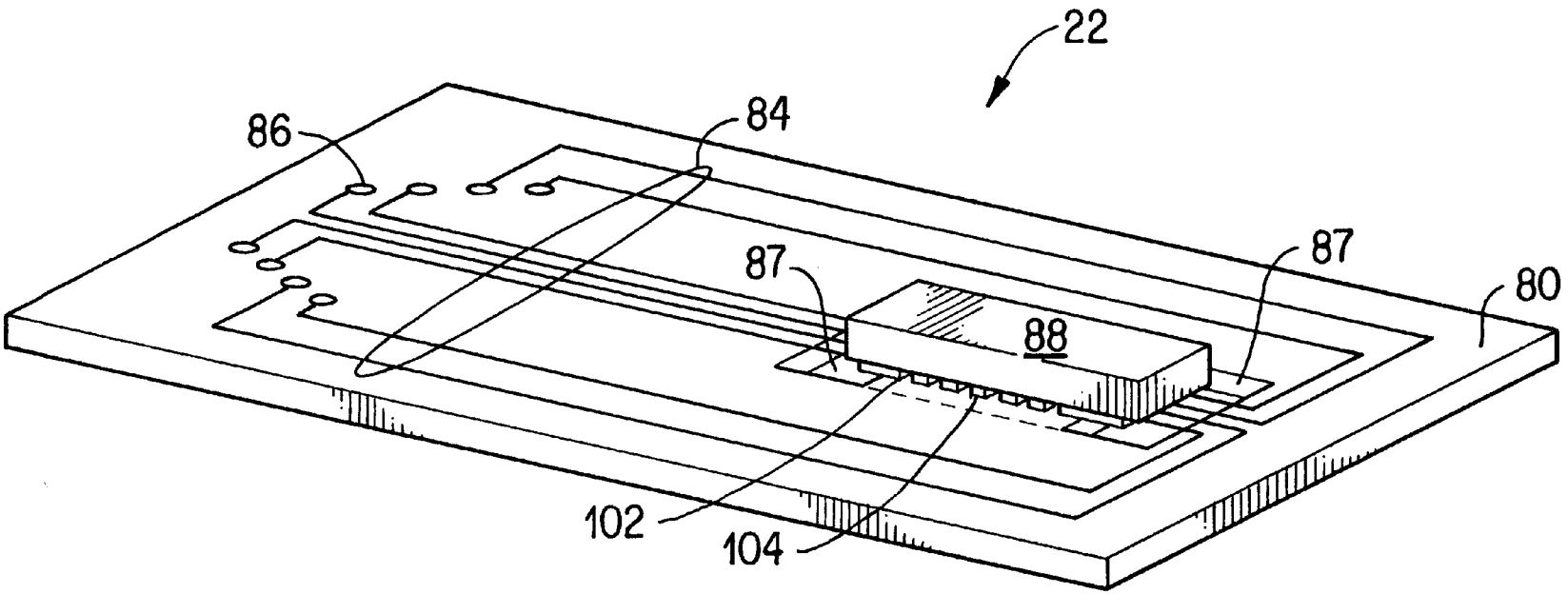
FIG. 3 is a highly schematic perspective view of the back side of a very simplified printhead assembly.

Referring to FIG. 3, printhead assembly 22 is preferably a flexible polymer tape 80, containing nozzles 82 formed therein by laser ablation, attached to a substrate, or die, 88 having ink ejection elements, or resistors, 44 formed thereon. Conductive traces 84 are formed on the back of tape 80 and terminate in contact pads 86 for contacting electrical contacts on carriage 16. The other ends of conductors 84 are bonded to electrodes 87 of substrate 88. Ink ejection chambers 102 are formed in a barrier layer 104 between the substrate 88 and the tape 80.

Figure 4:
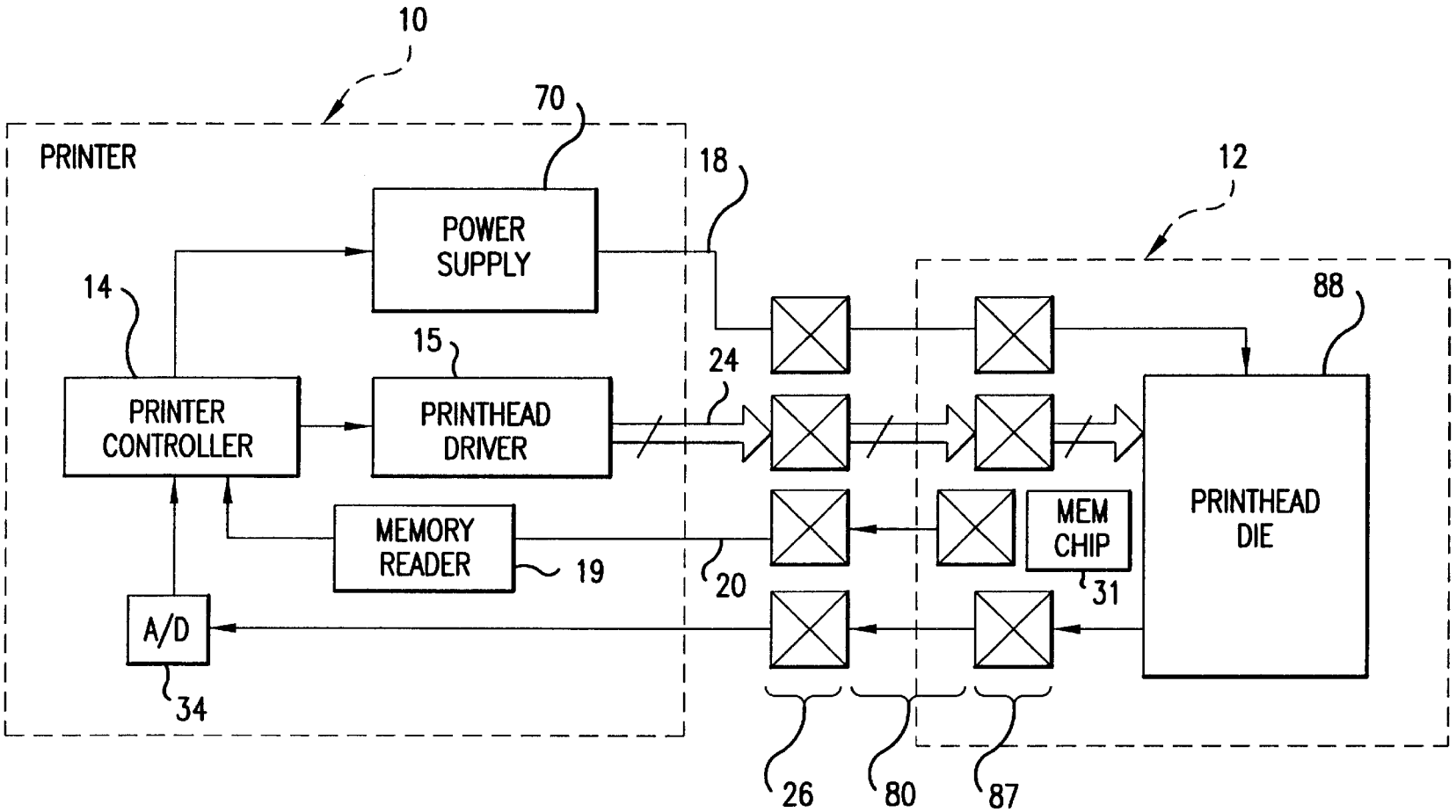
FIG. 4 is a schematic block diagram of a thermal inkjet printing apparatus according to a preferred embodiment of the invention.

FIG. 4 shows a schematic block diagram of an inkjet printer 10 with a connected print cartridge 12. A controller 14 in the printer 10 receives print data from a computer or microprocessor (not shown) and processes the data to provide printer control information or image data to a printhead driver circuit 15. A controlled voltage power supply 70 provides a controlled voltage to a power bus 18. A memory reader circuit 19 in the printer 10 is connected to the controller 14 for transmitting information received from the print cartridge 12 via a memory line 20. The printhead driver circuit 15 is controlled by the controller 14 to send the image data to a printhead die 88 on the print cartridge 12, via a control bus 24.

The cartridge 12 is removably replaceable and is electrically connected to the printer 10 by the control bus 24, power bus 18 and memory line 20. A connector interface 26 has a conductive pin for each line on the printer carriage side contacting a corresponding pad 86 on a flexible circuit tape 80 on the cartridge 12. A memory chip 31 on the cartridge stores printer control information programmed during manufacture of the cartridge and used by the printer during operation. The flex circuit 80 is connected to the printhead die 88 via bonds to electrodes 87. An analog-to-digital converter 34 in the printer is connected to the printhead to receive data from the printhead that indicates the printhead's temperature.

Figure 5:
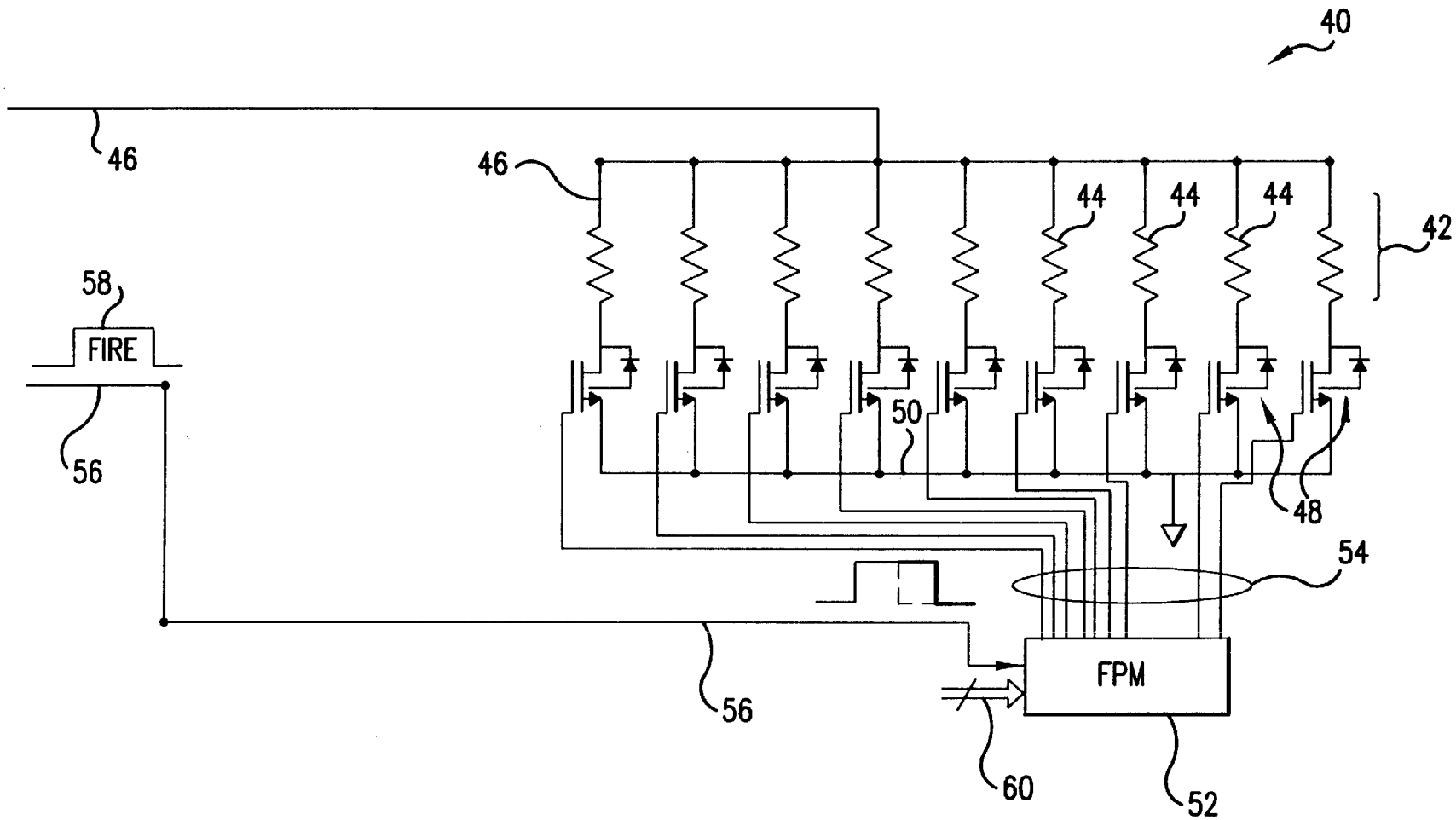
FIG. 5 is a detailed schematic of a printhead circuit of the embodiment of FIG. 2.

FIG. 5 shows a firing control circuit 40 and an exemplary fraction of the many resistors 44 on the printhead 22. Printhead 22 includes substrate 88 having firing resistors 44 and nozzles 82 in tape 80. The firing control circuit 40 resides on the printhead 22 substrate 88 and has a single pad to pad voltage input ("$V_{pp}$") 46 from the power bus 18 commonly connected to a set 42 of thin film firing resistors 44. Each firing resistor 44 is connected to a corresponding firing switch 48 connected to a ground line 50 and having a control input connected to the output 54 of a firing pulse modulator 52. The firing pulse modulator 52 receives print data on a bus 60 and outputs a firing signal on output lines 54 to each selected firing switch 48. To fire a selected group of the resistor set 42, the printer sends an input voltage $V_{pp}$ on line 46, and transmits a full-duration firing pulse 58 on line 56. In response to the firing pulse, the firing pulse modulator 52 transmits the firing pulse 58 to the resistor firing switches 48, causing the selected switches to close and connecting the resistors to ground to allow current flow through the resistors 44 to generate firing energy.

The printhead assembly 22 has a large number of nozzles 82 with a firing resistor 44 associated with each nozzle 82. In order to provide a printhead assembly where the resistors are individually addressable, but with a limited number of lines between the printer 10 and print cartridge 12, the interconnections to the resistors 44 in an integrated drive printhead are multiplexed. The print driver circuitry comprises an array of primitive lines 46, primitive commons 50, and address select lines 54 to control ink ejections elements 44. The printhead 22 may be arranged into any number of multiple similar subsections, such as quadrants, with each subsection being powered separately and having a particular number of primitives containing a particular number of resistors. Specifying an address line 54 and a primitive line 46 uniquely identifies one particular ink ejection element 44. The number of resistors within a primitive is equal to the number of address lines. Any combination of address lines and primitive select lines could be used, however, it is useful to minimize the number of address lines in order to minimize the time required to cycle through the address lines.

Each ink ejection element is controlled by its own drive transistor 48, which shares its control input address select with the number of ejection elements 44 in a primitive. Each ink ejection element is tied to other ink ejection elements 44 by a common node primitive select. Consequently, firing a particular ink ejection element requires applying a control voltage at its address select terminal and an electrical power source at its primitive select terminal. In response to print commands from the printer, each primitive is selectively energized by powering the associated primitive select interconnection. To provide uniform energy per heater ink ejection element only one ink ejection element is energized at a time per primitive. However, any number of the primitive selects may be enabled concurrently. Each enabled primitive select thus delivers both power and one of the enable signals to the driver transistor. The other enable signal is an address signal provided by each address select line only one of which is active at a time. Each address select line is tied to all of the switching transistors 82 so that all such switching devices are conductive when the interconnection is enabled. Where a primitive select interconnection and an address select line for a ink ejection element are both active simultaneously, that particular heater ink ejection element is energized. Only one address select line is enabled at one time. This ensures that the primitive select and group return lines supply current to at most one ink ejection element at a time. Otherwise, the energy delivered to a heater ink ejection element would be a function of the number of ink ejection elements being energized at the same time.

Additional details regarding the control of inkjet printheads are described in U.S. patent application Ser. No. 09/016,478, filed Jan. 30, 1998, entitled "Hybrid Multi-Drop/Multi-Pass Printing System" and U.S. patent application Ser. No. 08/962,031, filed Oct. 31, 1997, entitled "Ink Delivery System for High Speed Printing" which are herein incorporated by reference.

In existing printheads, an entire column of data is assembled in printer logic and the printer itself controls the sequence of energizing the printhead address and primitive lines which were demultiplexed. Moreover, prior printheads have a dedicated connection to a primitive line, primitive ground and address line for each firing resistor. A one time calibration of each connection by either the printer or production circuitry external to the print cartridge compensates for any parasitic resistance or impedance in the unique path leading to each resistor. Existing printheads may be characterized at production to set these operating parameters. The printer then uses these operating parameters.

However, in new printheads having smart integrated logic on the printhead, data is transmitted to the printhead and the printhead decodes this data into address and primitive control signals. Data for all address lines must be sequentially sent to the printhead for each address line. In the time domain, this is one ejection period. In the physical location domain, this is called one column. These smart drive printheads have a large number of resistors making it difficult to have a direct connection for the address lines, primitive lines and primitive grounds. Accordingly, in smart drive printheads each firing resistor may not have a dedicated connection. Without a dedicated connection there may be variations in delivered energy to a resistor due to parasitic resistances. A set of resistors, or a primitive, is powered by a single voltage line that receives power via an electrical interconnection between the print cartridge electrical pads 86 and corresponding pads on the printer carriage 16. Power to the carriage 16 from the regulated voltage 72 on the printer 10 is suppled by a flexible cable, or ribbon cable. The voltage line continues from the electrical contact pads 86 on a flexible electrical tape circuit 80 to a bonding connection to electrodes 87 on the printhead die 88. The printhead die 88 contains the firing resistors 44 and other control electronics, such as the drive transistors 48. The voltage line continues out from the printhead die 88 via a bonding connection to electrodes 87 on the printhead die 88 through the flexible electrical tape circuit 80 to print cartridge electrical pads. The voltage line continues to the carriage electrical interconnection between the print cartridge electrical pads 86 and to corresponding pads on the printer carriage 16. The voltage line continues from the carriage 16 to the voltage regulator 72 via the flexible cable, or ribbon cable.

The impedance of the print cartridge electrical contacts 86, flex circuit 80 bonding connections to the substrate, flex circuit trace resistances, substrate trace, transistor, resistor resistances, and other connections and lines, can vary from print cartridge to print cartridge. Also, the impedance of the print cartridge can vary over time, even when the voltage provided by the printer to each of the print cartridge electrical contacts is well controlled. Moreover, as the data load being printed changes, the current draw through the line and the voltage as measured at the firing resistor may be undesirably varied. For instance, when many or all resistors are fired simultaneously, the print cartridge voltage may be depressed by parasitic effects, giving a lower firing voltage than when only one or a few resistors are fired.

Because the voltage is regulated prior to the carriage to print cartridge interconnect, there is no consideration of the resistance past that point. Under heavy loading (i.e. single pass and/or high density prints), the parasitic voltage drop can be quite high. Since, the turn-on energy is set such that heavy loads can print, light loads (i.e. multiple pass and/or low density prints), which do not experience nearly as high a voltage loss through the lines, can be given significant amounts of over-energy.

The significantly different energy requirements for a loaded versus unloaded condition can be attributed to the method in which the voltages are set on printers. Printers often regulate the printhead voltage based on a voltage sensed near the power supply 70. This voltage is before the printer flexible electrical cable from the printer 10 to the carriage 16 and therefore neglects the cable resistance as well as the resistance of the carriage 16 circuit board and the carriage to print cartridge interconnect. As the current required to drive the print cartridges increases, the parasitic voltage drop increases. The situation is improved if the regulator senses the voltage closer to the printhead, such as at the circuit board on the carriage 16 just before the carriage 16 electrical interconnects to the print cartridge 12, but a problem with parasitic resistances and voltage drop still remains.

For details on methods to determine the operating energy for a print cartridge, see U.S. patent application Ser. No. 09/071,138, filed Apr. 30, 1998, entitled "Energy Control Method for an Inkjet Print Cartridge;" U.S. patent application Ser. No. 08/958,951, filed Oct. 28, 1997, entitled "Thermal Ink Jet Print Head and Printer Energy Control Apparatus and Method," U.S. Pat. No. 5,418,558, entitled "Determining the Operating Energy of a Thermal Ink Jet Printhead Using an Onboard Thermal Sense Resistor," U.S. Pat. No. 5,428,376, entitled "Thermal Turn on Energy Test for an Inkjet Printer;" and U.S. Pat. No. 5,682,185 entitled "Energy Management Scheme for an Ink Jet Printer;" The foregoing commonly assigned patents and patent applications are herein incorporated by reference.

The operating energy and operating voltage In operation, the power supply voltage is set to a level adequate to ensure adequate firing energy levels for full drop volume firing in "blackout conditions," i.e., when a predetermined number of resistors are fired simultaneously. Because firing energy is proportional to the product of the square of the voltage and the time duration, the power supply voltage must be high enough to provide adequate energy within the limited time afforded for printing each dot, before the next dot is to be printed at the desired printer scan rate. Part of the calibration process includes establishing a voltage to provide a firing energy threshold for all firing conditions, regardless of the number of resistors being fired simultaneously.

The specific dot pattern placed on the media in each pass and the way in which these different dot patterns add up to a final complete image, is known as a "printmode." The concept of printmodes is a useful and well-known technique of laying down in each pass of the printhead only a fraction of the total ink required in each section of the image, so that any areas left white in each pass are filled in by one or more later passes. This tends to control bleed, blocking and cockle by reducing the amount of liquid that is on the page at any given time. Printmodes allow a trade-off between speed and image quality. For example, a printer's draft mode provides the user with readable text as quickly as possible. Presentation, also known as best mode, is slow but produces the highest image quality. Normal mode is a compromise between draft and presentation modes. Printmodes allow the user to choose between these trade-offs. It also allows the printer to control several factors during printing that influence image quality, including: 1) the amount of ink placed on the media per dot location, 2) the speed with which the ink is placed, and, 3) the number of passes required to complete the image. Providing different printmodes to allow placing ink drops in multiple swaths can help with hiding nozzle defects. Different printmodes are also employed depending on the media type.

One-pass mode operation is used for high throughput on plain paper. The one pass mode is one in which all dots to be fired on a given row of dots are placed on the medium in one swath of the print head, and then the print medium is advanced into position for the next swath.

A two-pass printmode is a print pattern wherein one-half of the dots available for a given row of available dots per swath are printed on each pass of the printhead, so two passes are needed to complete the printing for a given row. Typically, each pass prints one-half of the dots on the swath area. Similarly, a four-pass mode is a print pattern wherein one fourth of the dots for a given row are printed on each pass of the printhead and an eight-pass mode is a print pattern wherein one eighth of the dots for a given row are printed on each pass of the printhead. Multiple pass thermal ink-jet printing is described, for example, in commonly assigned U.S. Pat. No. 4,963,882, entitled "Printing of Pixel Locations by an Ink Jet Printer Using Multiple Nozzles for Each Pixel or Pixel Row;" U.S. Pat. No. 4,965,593, entitled "Print Quality of Dot Printers;" and U.S. Pat. No. 5,555,006, entitled "Inkjet Printing: Mask-rotation-only at Page Extremes; Multipass Modes for Quality and Throughput on Plastic Media" and U.S. patent applications Ser. No.08/810,747, filed Mar. 4, 1997, entitled "Bidirectional Color Printmodes with Semistaggared Swaths to Minimize Hue Shift and Other Artifacts;" Ser. No. 08/814,949, filed Mar. 10, 1997 entitled "Random Printmasks in a Multilevel Inkjet Printer;" Ser. No.08/811,875, filed Mar. 4, 1997, entitled "Bi-directional Color Printing Using Multipass Printmodes with Swath-aligned Inkjet Printheads;" Ser. No. 08/811,788, filed Mar. 4, 1997, entitled "High Resolution Inkjet Printing Using Color Drop Placement on Every Pixel Row During a Single Pass." and Ser. No. 08/810,467, filed Mar. 4, 1997, entitled "Dynamic Multi-pass Print Mode Corrections to Compensate for Malfunctioning Inkjet Nozzles." The foregoing commonly assigned U.S. patents and U.S. patent applications are hereby incorporated by reference.

The pattern used in printing each nozzle section is known as the "printmode mask" or "printmask", or sometimes just "mask." A printmask is a binary pattern that determines exactly which ink drops are printed in a given pass or conversely, which passes are used to print each pixel. In a printmode of a certain number of passes, each pass generally prints of all the ink drops to be printed, a fraction equal roughly to the reciprocal of the number of passes. Accordingly, the number of resistors being fired is also a fraction equal roughly to the reciprocal of the number of passes. Thus, the printmask defines both the pass and the nozzle which will be used to print each pixel location, i.e., each row number and column number on the media. The printmask can be used to "mix up" the nozzles used, as between passes, in such a way as to reduce undesirable visible printing artifacts. The term "printmode" is more general, usually encompassing a description of a printmask, or several printmasks, used in a repeated sequence and the number of passes required to reach "full density," and also the number of drops per pixel defining what is meant by full density.

Experiments have shown that the amount of operating energy a printer needs to deliver to a print cartridge varies depending on how frequently the print cartridge is being fired, and also how frequently the other print cartridges in the printing system are being fired. A print cartridge firing only a few of its resistors and with no other print cartridge resistors being fired simultaneously, needed an operating energy at the printer contacts to the print cartridge which was much less than the operating energy required when the same print cartridge was printing with all of its resistors firing. Also, a print cartridge firing only a few of its resistors, but with other print cartridge resistors being fired simultaneously, needed an operating energy which was approximately the same as the operating energy required when the same print cartridge was printing with all of its resistors firing. In addition, a print cartridge printing data in a four-pass printmode needed much less energy when printing the same data in a one-pass printmode.

This creates a problem because when the operating energy is set high enough to power a print cartridge when all of its resistors and all of the resistors of all the other print cartridges are being fired, too much energy is delivered to the print cartridge when only a few of its resistors of are being fired and no other print cartridges are being simultaneously fired. This excess energy leads to rapid formation of films on the resistors ("kogation"). High amounts of excess energy are also implicated in shortened resistor life and the generation of excess heat in the printhead. High amounts of excess energy also may cause thermal shutdown and no drop ejection.

As discussed above, with direct drive and integrated drive printheads using multiplexing each of the primitives has a direct connection to a constant voltage source and therefore primitives have very little effect on each other. However, with the new smart drive printheads these primitives may be coupled together and connected to a constant voltage source. This means that when a different number of these coupled primitives are fired, they utilize differing amounts of current from the voltage source. Thus, the resistances in the circuit which are common to the different primitives cause a parasitic voltage loss which is proportional to the number of primitives fired.

The present invention takes these differences between the printmodes into account and adjusts the nominal operating energy of the print cartridge depending on the printmode being used by the printer for a particular swath. Similarly, a higher or lower target operating voltage can be set for the black print cartridge if there is or is not a color print cartridge also printing during the swath, respectfully. Stated another way the present invention alters the target operating voltage based on the maximum common parasitic loss which can be expected in a particular printmode.

Figure 6:
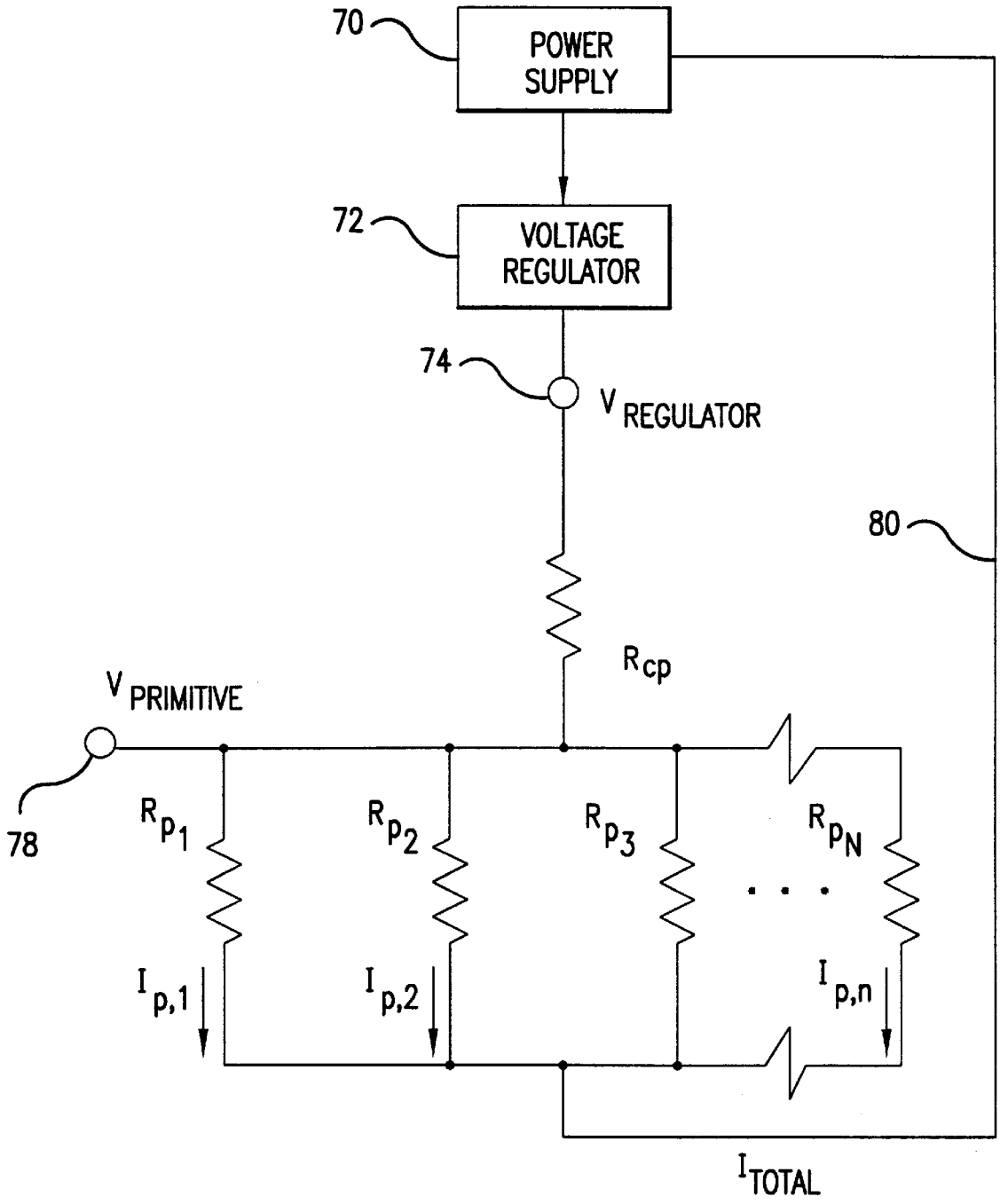
FIG. 6 is a schematic block diagram of a power supply, voltage regulator and a single print cartridge circuit.

Referring to FIG. 6, printers generally regulate the printhead voltage based on a voltage sensed as close to the printhead as possible, such as at the circuit board on the carriage 16 before the carriage electrical interconnects to the print cartridge 12. The output of the voltage regulator 72 is constant and set to $V_{regulator}$. The output of the voltage regulator flows through a set of common parasitic resistances, $R_{cp}$, between the voltage regulator and the print cartridge primitives. Thus, voltage and energy is dissipated in $R_{cp}$ and $V_{regulator}$ must be set high enough to compensate for this voltage loss.

When All Primitives Fire

Assume that $V_{regulator}$ is set to be the voltage at point 74 required to fire all of the primitives at the same time. If the minimum voltage at point 78 required to fire a primitive is $V_{primitive,\ min}$, which is a constant under all operating conditions, then the minimum energy, $E_{primitive,\ min}$, to fire a primitive is $$E_{primitive,\ min}=[(V_{primitive,\ min})^2/R_{primitive}]*PW$$

where PW is the pulse width.

Assuming that $$R_{primitive,\ 1}=R_{primitive,\ 2}=R_{primitive,\ Np}=R_{primitive}$$

then $$I_{primitive,\ 1}=I_{primitive,\ 2}=I_{primitive,\ Np}=I_{primitive},$$

and $$I_{primitive}=(V_{primitive})/R_{primitive}$$

The total current is then $$I_{total}=N_p{}^*I_{primitive}$$

The voltage drop across $R_{cp}$ is now, $$\begin{aligned} V_{regulator}-V_{primitive} &= I_{total}*R_{cp} \\ &= N_p*(V_{primitive,\min}/R_{primitive})*R_{cp} \end{aligned}$$

$V_{regulator}$ is set so that when the maximum current is drawn through common parasitic resistance $R_{cp}$, (i.e., when all primitives are firing) the voltage at point 78, $V_{primitive}$, is equal to $V_{primitive,\ min}$. The minimum regulator voltage, $V_{regulator,\ min}$, to provide $V_{primitive,\ min}$ at point 78 would be:

$$\begin{aligned} V_{regulator,\min} &= V_{primitive,\min}+(I_{total}*R_{cp}) \\ &= V_{primitive,\min}+[(N_p)*(V_{primitive}/R_{primitive})]*R_{cp}, \end{aligned}$$

where $N_p$ is the total number of primitives and $V_{primitive}=V_{primitive,\ min}$ because it is desired to set lowest voltage possible that still ensures that all primitives can fire. The minimum energy to fire a primitive is $$E_{primitive,\ min}=[(V_{primitive})^2/R_{primitive}]*PW$$

When Only One of the Primitives Fires

Now consider the case where only one of the primitives fires, i.e., $N_p=1$. In this case if the voltage regulator is set as above, i.e., assuming all primitives will be firing:

$$\begin{aligned} V_{regulator} &= V_{primitive,\min}+N_p*(V_{primitive}/R_{primitive})*R_{cp} \\ &= V_{primitive,\min}*[1+N_p*(R_{cp}/R_{primitive})] \end{aligned}$$

The voltage drop across $R_{cp}$ is now, $$\begin{aligned} V_{regulator}-V_{primitive} &= I_{primitive}*R_{cp} \\ &= (V_{primitive}/R_{primitive})*R_{cp} \end{aligned}$$

Solving for $V_{primitive}$ gives:

$$V_{regulator} = V_{primitive} * [1 + (R_{cp} / R_{primitive})]$$

$$V_{primitive} = V_{regulator} / [1 + (R_{cp} / R_{primitive})] = V_{primitive,\min} * [1 + N_p * (R_{cp} / R_{primitive})] / [1 + (R_{cp} / R_{primitive})]$$

Calculating the ratio $V_{primitive}/V_{primitive,\ min}$ gives $$V_{primitive}/V_{primitive,\ min}=[1+N_p*(R_{cp}/R_{primitive})]/[1+(R_{cp}/R_{primitive})]$$

If $N_p>1$, then $V_{primitive}/V_{primitive,\ min}$ will be greater than 1.

This means excess voltage is being applied to the one primitive firing and the excess energy is $$E_{excess}=(V_{primitive}/V_{primitive,\ min})^2$$

Assuming $V_{regulator}$ is adjusted based on the number of primitives, or resistors, which are be fired within a given period of time, in a particular print mode of P passes. When P passes are used, the total number of firing primitives in one pass approximately equals $N_p/P$. After all P passes all $N_p$ primitives will have fired.

In this case, $V_{regulator}$ would be set to $$V_{regulator}=V_{primitive,\ min}*[1+(N_p/P)*(R_{cp}/R_{primitive})]$$

when the present invention is applied instead of $$V_{regulator}=V_{primitive,\ min}*[1+(N_p)*(R_{cp}/R_{primitive})].$$

The $V_{primitive}/V_{primitive,\ min}$ ratio when firing a single primitive would then be:

$$V_{primitive}/V_{primitive,\ min}=[1+(N_p/P\ R_{cp}/R_{primitive})]/[1+(R_{cp}/R_{primitive})]$$

and the excess voltage and energy that is applied is less than in the former case.

Multiple Print Cartridge

Figure 7:
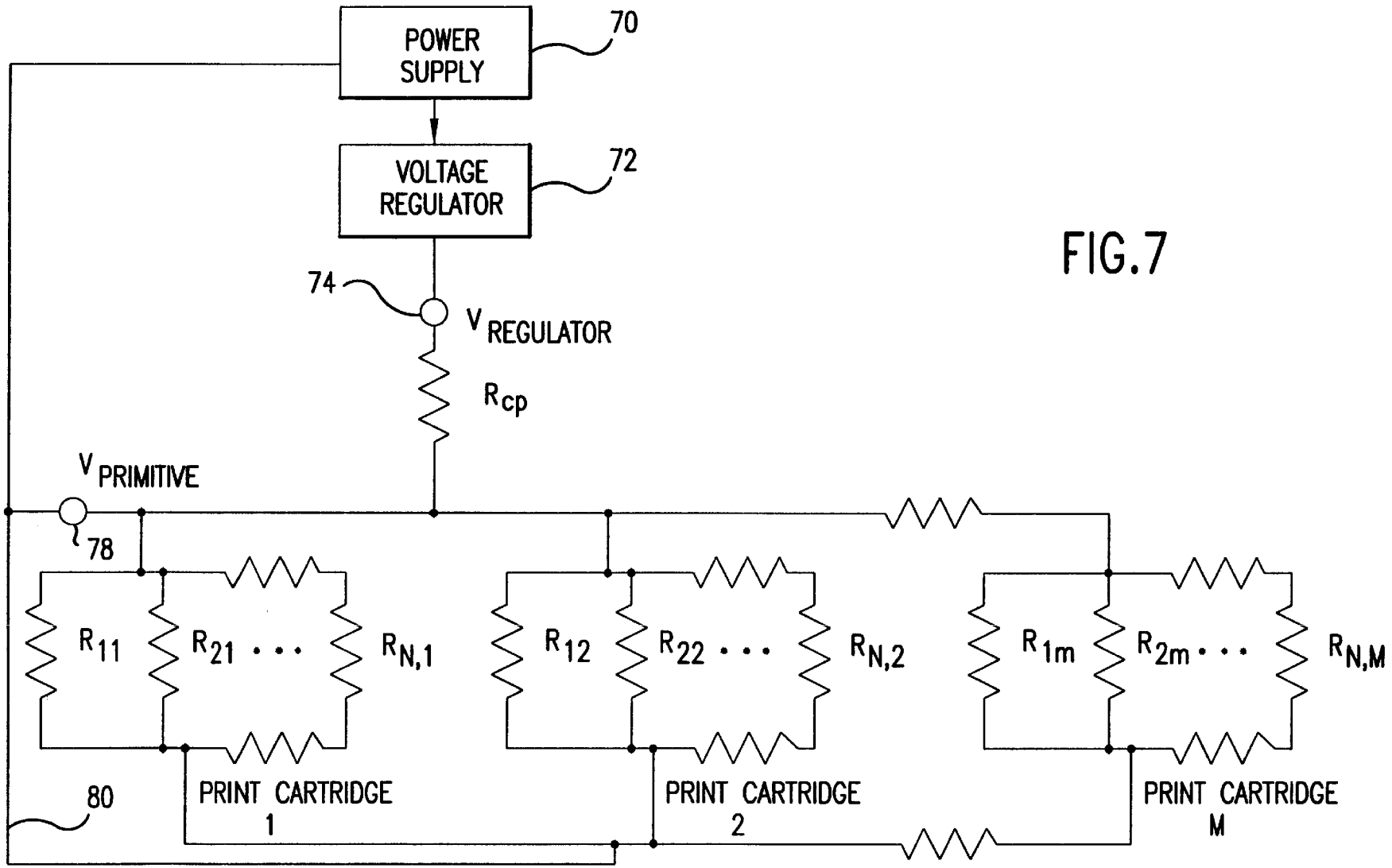
FIG. 7 is a schematic block diagram showing a power supply, voltage regulator and multiple print cartridge circuits.

Referring to FIG. 7, the present invention can be applied to the case where M multiple print cartridges each with $N_p$ primitives are supplied from a common voltage regulator 72. In this case, both the number of primitives fired simultaneously and the number of print cartridges fired simultaneously, should be considered when $V_{regulator}$ is set. In this case without the present invention the voltage would be $$V_{regulator}=V_{primitive,\ min}+[M*N_p*(V_{primitive,\ min}R_{primitive})*R_{cp}]$$

whereas with the present invention voltage would be $$V_{regulator}=V_{primitive,\ min}+[F*M*N_p*(V_{primitive,\ min}/R_{primitive})*R_{cp}]$$

where F is the fraction of the primitives, or resistors, on all print cartridges which are firing within a given period of time.

Multiple Voltage Regulators

Figure 8:
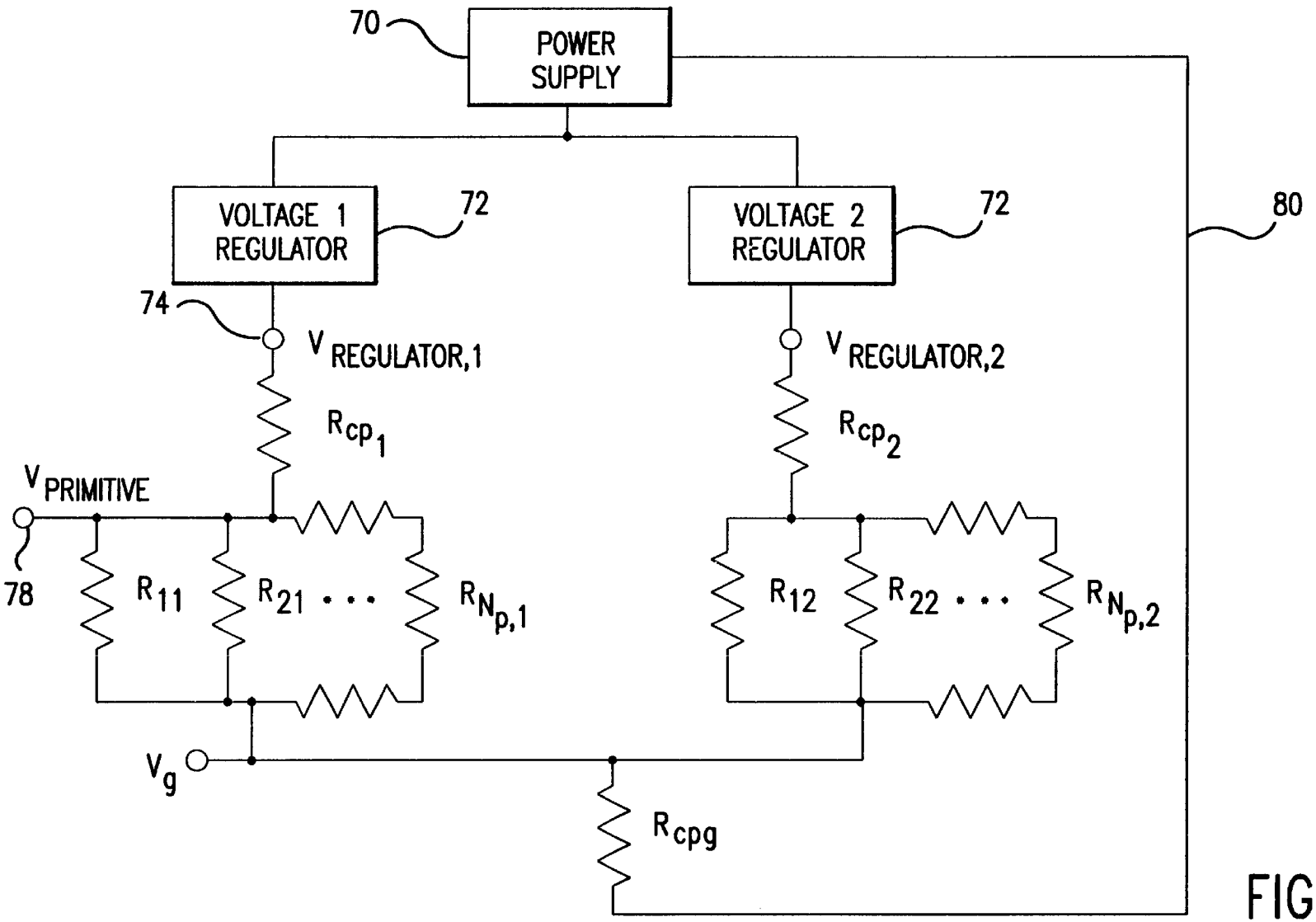
FIG. 8 is a schematic block diagram showing a power supply, two voltage regulators and multiple print cartridge circuits.

Referring to FIG. 8, another example of the present invention applies with separate voltage regulators for different print cartridges. In this case, the amount of current drawn by a second print cartridge can affect the firing voltage of the other print cartridge (and thus its firing energy) as follows.

The first effect is power supply "sag." With one print cartridge firing at a high duty cycle, the power supply and voltage regulators may be unable to maintain $V_{regulator,\ 1}$ and $V_{regulator,\ 2}$ at their necessary levels. The present invention deals with this by setting $V_{regulator}$ set to a higher voltage than would be normally needed in case the second voltage regulator pulls more current than the power supply can deliver without sagging. Then, when the second print cartridge is not firing at a high duty cycle, the power supply does not sag and excess energy is applied to the print cartridge powered by the first voltage regulator.

The second effect occurs if the print cartridges are connected to a common ground, and there is a common parasitic resistance in the ground line 80 between the print cartridges and the power supply 70, shown as $R_{cpg}$. Here a high duty cycle in one print cartridge creates a ground voltage, $V_g$, through the current flowing through $R_{cpg}$. This means the voltage dissipated in the primitives (for firing the print cartridge) is decreased from $V_{primitive}$ to $V_{primitive-Vg}$. To compensate for this, $V_{regulator}$ must be set proportionally higher using equations similar to those shown in the first example. In this case, when the second print cartridge does not fire, the first print cartridge is supplied with excess voltage and energy.

Using the present invention, $V_{regulator}$ would not necessarily be set assuming the maximum parasitic loss possible. Instead, the printmode, number of simultaneously firing primitives, and number of simultaneously firing print cartridges would all be factors.

Accordingly, print cartridges having shared power and ground lines and parasitic resistances in these lines result in variations in delivered energy to the primitives in a print cartridge. The present invention takes these common parasitic resistances into account and adjusts the target operating voltage depending on the printmode in effect for any particular swath or part of a swath. More specifically, it considers a predetermined number of primitives which can fire simultaneously and adjusts the target voltage of the voltage regulator to compensate for the maximum expected voltage loss through the common parasitic resistances.

Another embodiment of the present invention is to set a higher or lower target voltage for the black printhead depending on whether there was or was not a color printhead also printing during the swath. For example, if no color printhead is fired during a swath, the ground return resistance can be treated like the other common resistances.

While the above is discussed in terms of specific and alternative embodiments, the invention is not intended to be so limited.

What is claimed is:

1. A method of operating an inkjet printer having one or more inkjet printer cartridges installed in the printer, wherein the printer is capable of operating under varying operating conditions and in a plurality of different printmodes, comprising:

obtaining a value for common parasitic resistances and a base operating voltage setting for the inkjet printer when a predetermined number of possible resistors on the print cartridge are firing during a given period of time;

determining an actual number of resistors firing on the print cartridge during the given period of time;

adjusting the base operating voltage setting to a selected voltage setting based on the results of said obtaining step and said determining step; and operating the printer using the selected operating voltage setting for the print cartridge.

2. The method of claim 1, wherein the obtaining includes reading the base operating voltage from the print cartridge.

3. The method of claim 1, wherein the obtaining includes the printer calculating the base operating voltage for the print cartridge.

4. The method of claim 1, wherein the obtaining includes reading the common parasitic resistance from the print cartridge.

5. The method of claim 1, wherein the obtaining includes the printer calculating the common parasitic resistance for the print cartridge.

6. The method of claim 1, wherein the obtaining includes setting the predetermined number of possible resistors to the maximum number of resistors that can be fired in the given period of time.

7. The method of claim 1, wherein the determining includes the printer obtaining the actual number of resistors firing from a printhead driver on the printer.

8. The method of claim 1, wherein the determining step includes the printer obtaining an actual number of primitives firing from a printhead driver on the printer.

9. The method of claim 1, wherein the adjusting step is based on a number of firing primitives during the given period of time and the common parasitic resistances.

10. The method of claim 1, wherein the adjusting step is based on the total current through the number of firing resistors and the common parasitic resistances.

11. The method of claim 1, wherein the adjusting is based on a current printmode in effect.

12. The method of claim 1, wherein the adjusting is based on the number of print cartridges firing during the given period of time.

13. The method of claim 1, wherein the adjusting step includes using the following equation to adjust the base operating voltage:

$$V_{regulator}=V_{primitive,\ min}*[1+(N_p/P)*(R_{ep}/R_{primitive})]$$

where $V_{regulator}$ is the voltage required to fire all the primitives at the same time, $V_{primitive,\ min}$ is the voltage required to fire one primitive, $N_p$ is the total number of primitives, P is the printmode or the number of passes, $R_{ep}$ is the common parasitic resistance and, $R_{primitive}$ is the total resistance of a primitive.

14. The method of claim 1, wherein the adjusting step includes using the following equation to adjust the base operating voltage:

$$V_{regulator}=V_{primitive,\ min}+[F*M*N_p*(V_{primitive,\ min}/R_{primitive})*R_{ep}]$$

where $V_{regulator}$ is the voltage required to fire all the primitives at the same time, $V_{primitive,\ min}$ is the voltage required to fire one primitive, F is the fraction of primitives, or resistors on all print cartridges that are firing within a period of time, M is the number of print cartridges, $N_p$ is the total number of primitives, $R_{ep}$ is the common parasitic resistance and $R_{primitive}$ is the total resistance of a primitive.

15. A method of operating an inkjet printer having an inkjet print cartridge installed in the printer, wherein the printer is capable of operating in a plurality of different printmodes, comprising:

obtaining a base operating voltage setting for the inkjet printer when a predetermined number of possible resistors on the print cartridge are firing during a given period of time, a current printmode in effect and a value for the common parasitic resistances;

determining an actual number of resistors firing on the print cartridge during the given period of time based on the current printmode in effect;

adjusting the base operating voltage setting to a selected voltage setting based on the results of said obtaining step and said calculating step; and operating the printer using the selected operating voltage setting for the print cartridge.

16. The method of claim 15, wherein the obtaining includes reading the base operating voltage and the common parasitic resistance from the print cartridge.

17. The method of claim 15, wherein the obtaining includes the printer calculating the base operating voltage and common parasitic resistance for the print cartridge.

18. The method of claim 15, wherein the obtaining includes setting the predetermined number of possible resistors to the maximum number of resistors that can be fired in the given period of time.

19. The method of claim 15, wherein the determining includes the printer obtaining the actual number of resistors firing from a printhead driver on the printer.

20. The method of claim 15 wherein the determining step includes the printer obtaining an actual number of primitives firing from a printhead driver on the printer.

21. The method of claim 15, wherein the adjusting step is based on a number of firing primitives during the given period of time and the common parasitic resistances.

22. The method of claim 15, wherein the adjusting step is based on the total current through the number of firing resistors and the common parasitic resistances.

23. The method of claim 15, wherein when the inkjet printer has a plurality of print cartridges installed therein and the adjusting step is based on the number of print cartridges firing during the given period of time.

24. The method of claim 15, wherein the adjusting step includes using the following equation to adjust the base operating voltage:

$$V_{regulator}=V_{primitive,\ min}*[1+(N_p/P)*(R_{ep}/R_{primitive})]$$

where $V_{regulator}$ is the voltage required to fire all the primitives at the same time, $V_{primitive,\ min}$ is the voltage required to fire one primitive, $N_p$ is the total number of primitives, P is the printmode or the number of passes, $R_{ep}$ is the common parasitic resistance and, $R_{primitive}$ is the total resistance of a primitive.

25. The method of claim 15, wherein the adjusting step includes using the following equation to adjust the base operating voltage:

$$V_{regulator}=V_{primitive,\ min}+[F*M*N_p*(V_{primitive,\ min}/R_{primitive})*R_{ep}]$$

where $V_{regulator}$ is the voltage required to fire all the primitives at the same time, $V_{primitive,\ min}$ is the voltage required to fire one primitive, F is the fraction of primitives, or resistors on all print cartridges that are firing within a period of time, M is the number of print cartridges, $N_p$ is the total number of primitives, $R_{ep}$ is the common parasitic resistance and $R_{primitive}$ is the total resistance of a primitive.

* * * * *